US010415277B2

(12) United States Patent
Lee et al.

(10) Patent No.: US 10,415,277 B2
(45) Date of Patent: Sep. 17, 2019

(54) HOOD LATCH ASSEMBLY FOR VEHICLE AND METHOD OF ACTUATING THE SAME

(71) Applicant: Hyundai Motor Company, Seoul (KR)

(72) Inventors: Kyung-Tae Lee, Seoul (KR); Tae-Young Cho, Seoul (KR); Jong-Il Shin, Busan (KR); Won-Ho Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 709 days.

(21) Appl. No.: 15/143,318

(22) Filed: Apr. 29, 2016

(65) Prior Publication Data

US 2017/0101810 A1 Apr. 13, 2017

(30) Foreign Application Priority Data

Oct. 7, 2015 (KR) ..... 10-2015-0141143

(51) Int. Cl.

| | |
|---|---|
| ***E05B 83/24*** | (2014.01) |
| ***E05B 79/14*** | (2014.01) |
| ***E05B 79/16*** | (2014.01) |
| ***E05B 85/24*** | (2014.01) |
| *E05B 5/02* | (2006.01) |
| *E05B 85/10* | (2014.01) |

(52) U.S. Cl.

CPC ..... *E05B 83/24* (2013.01); *E05B 79/14* (2013.01); *E05B 79/16* (2013.01); *E05B 85/243* (2013.01); *E05B 5/003* (2013.01); *E05B 85/107* (2013.01); *Y10S 292/14* (2013.01); *Y10S 292/31* (2013.01)

(58) Field of Classification Search

CPC ..... Y10S 292/14; Y10S 292/31; E05B 5/003; E05B 85/107; E05B 83/24; E05B 83/243

USPC ..... 292/336.3; 296/193.11; 180/69.21

See application file for complete search history.

(56) References Cited

U.S. PATENT DOCUMENTS 2,206,137 A * 7/1940 Tedtman ..... E05B 83/24 292/153
2,809,064 A * 10/1957 Dlugatch ..... E05B 83/24 292/210
2,998,992 A * 9/1961 Brankovic ..... E05B 5/003 292/1
4,991,884 A * 2/1991 Cairns ..... E05B 83/24 292/28

(Continued)

FOREIGN PATENT DOCUMENTS

DE 102009036760 A1 * 3/2010 ..... E05B 83/24
EP 3130730 A1 * 2/2017 ..... E05B 79/22

(Continued)

*Primary Examiner* — Carlos Lugo

(74) *Attorney, Agent, or Firm* — Mintz Levin Cohn Ferris Glovsky and Popeo, P.C.; Peter F. Corless

(57) ABSTRACT

A hood latch assembly for a vehicle is provided. The assembly includes a first latch that is rotated in a first opening direction by a first lever disposed within a driver's seat, to push a striker mounted on a lower surface of a hood to pop up the hood. A second latch restricts or releases the striker to couple or decouple the hood to or from a vehicle body. A second lever rotates the second latch to allow the second latch to release restriction of the striker, and a housing accommodates the first and second latches and the second lever. Additionally, an extendable lever is disposed at a side of the second lever, and extends, when the hood is popped up, to protrude outward.

17 Claims, 13 Drawing Sheets

(56) References Cited

U.S. PATENT DOCUMENTS

| | | | | | |
|---|---|---|---|---|---|
| 5,000,493 | A * | 3/1991 | Bastien | E05B 83/24 | 292/11 |
| 5,046,768 | A * | 9/1991 | Myslicki | E05B 83/24 | 292/304 |
| 5,150,933 | A * | 9/1992 | Myslicki | E05B 83/16 | 292/216 |
| 5,735,511 | A * | 4/1998 | Stocker | E05F 5/022 | 248/569 |
| 5,853,060 | A * | 12/1998 | Chao | E05B 83/16 | 180/69.2 |
| 6,474,119 | B1 * | 11/2002 | Halvorson | E05B 85/107 | 292/336.3 |
| 6,598,912 | B2 * | 7/2003 | Hillgaertner | E05B 13/005 | 292/225 |

FOREIGN PATENT DOCUMENTS

| | | | | | |
|---|---|---|---|---|---|
| GB | 453333 | A * | 9/1936 | E05B 5/003 | |
| GB | 683445 | A * | 11/1952 | E05B 5/003 | |
| KR | 1996-0001137 | Y1 | 5/1996 | | |
| KR | 2001129420000 | Y1 | 11/1997 | | |
| KR | 2002-0077981 | A | 10/2002 | | |
| KR | 10-2006-0009733 | A | 2/2006 | | |
| KR | 2006-0065861 | A | 6/2006 | | |
| KR | 10-2010-0025114 | A | 3/2010 | | |

* cited by examiner

HOOD LATCH ASSEMBLY FOR VEHICLE AND METHOD OF ACTUATING THE SAME

CROSS-REFERENCE TO RELATED APPLICATIONS

This application claims priority to Korean Patent Application No. 10-2015-0141143, filed on Oct. 7, 2015, which is incorporated herein by reference in its entirety.

BACKGROUND

Field of the Invention

The present invention relates to a hood latch assembly for a vehicle and a method of actuating the same; and, more particularly, to a hood latch assembly for a vehicle, which includes an extendable lever having a variable length, and a method of actuating the same.

Description of Related Art

In general, a hood is mounted to an engine room of a vehicle to shield the main components of the vehicle, such as an engine installed in the engine room, from the outside. This hood is hinged to the opened upper surface of the engine room in front of a vehicle body, and pivots about a hinge portion to be opened and closed. The hood is locked and unlocked using a hood latch. The hood latch includes a fork portion (e.g., a first latch) which catches and fixes a striker, and a hook portion (e.g., a second latch) by which the striker is hooked after the hood is opened (e.g., popped, unlocked, etc.). The fork portion is released by the operation of a hood lever mounted within the vehicle, and the hook portion is released by a latch handle mounted to the hood latch.

FIG. 1 is a detailed view illustrating a hood latch assembly for a vehicle according to the prior art. FIG. 2 is a front view illustrating the hood latch assembly for a vehicle according to the prior art. Referring to FIGS. 1 and 2, in the hood latch assembly, when a driver or an operator opens a hood to check an engine room, a striker caught by a fork portion (e.g., a first latch) is unlocked by the operation of a hood lever (e.g., a first lever) installed within the vehicle, thereby allowing the hood to be popped up (e.g., opened) and slightly lifted up. In particular, the striker is hooked and locked by a hook portion (e.g., a second latch) when a gap is formed between a hood and a vehicle body.

Additionally, a latch handle (e.g., a second lever) may be operated by inserting a hand or other object into the gap formed between the hood and the vehicle body, and lifting the hood after releasing the hook portion, by which the striker is hooked, to thus fully open the engine room. In other words, the hood latch assembly of the prior art has a double latch structure. When the hood lever mounted within the vehicle is inadvertently operated while the vehicle is being driven, the hood may be opened by exterior wind blowing opposite to the direction in which the vehicle is traveling thus blocking the driver's view of the road. Accordingly, the above structure is used to prevent a risk of accidents that may be caused due to inadvertent operation.

However, since the conventional hood latch handle is disposed within the engine room, in to open the hood, after the gap (e.g., the hood is partially opened) is formed by operating the hood lever mounted within the vehicle after the hood lever is lifted by a predetermined height, a driver or operator identifies the position of the hood latch handle by inserting his/her hand into the gap, and then operates the hood latch handle. Accordingly, it may be difficult for the driver or operator to detect the hood latch handle due to the space constraints of the gap formed between the hood and the vehicle body.

SUMMARY

The present invention provides a hood latch assembly for a vehicle, which may include an extendable lever that protrudes outward when a hood is popped up, and a method of actuating the same. Other objects and advantages of the present invention can be understood by the following description, and become apparent with reference to the embodiments of the present invention. Also, it is obvious to those skilled in the art to which the present invention pertains that the objects and advantages of the present invention may be realized by the means as claimed and combinations thereof.

In accordance with an exemplary embodiment of the present invention, a hood latch assembly for a vehicle may include a first latch (100) rotated in a first opening direction (A) by operation of a first lever disposed within a driver's seat, to push a striker (2) mounted on a lower surface of a hood (1) to pop up (e.g., unlatch) the hood (1), a second latch (200) configured to restrict or release the striker (2), to couple or decouple the hood (1) to or from a vehicle body (3), a second lever (300) configured to rotate the second latch (200) to cause the second latch (200) to release the restriction of the striker (2), and a housing (400) including the first and second latches (100 and 200) and the second lever (300). The hood latch assembly may further include an extendable lever (500) disposed at a side of the second lever (300), and extending, when the hood (1) is popped up, to protrude outward.

Additionally, the hood latch assembly may include a second link (600), a first end of which may be mounted to a lower surface of the extendable lever (500) and a first link (800), a first end of which may be connected to a second end of the second link (600) through a joint (700) while a second end thereof may be rotatably connected to a lower end of the first latch (100). The hood latch assembly may further include a guide link (900), a first end of which may be rotatably connected to the joint (700) while a second end thereof may be inserted into a guide aperture (410) formed in the housing (400), to guide a movement path of the joint (700). The joint (700) may include a first joint aperture (710) into which a first end of the first link (800) may be inserted, a second joint aperture (720) into which a second end of the second link (600) may be inserted, and a joint spring (730) disposed in the second joint aperture (720) to apply elastic force to the second link (600) to cause the extendable lever (500) to be spaced apart from the second lever (300) by a predetermined distance.

Furthermore, the extendable lever (500) may include a cover (510), having a first aperture (511) formed in a front surface thereof and a second aperture (512) formed in a side thereof toward the second lever (300), a protrusion section (520) disposed inside the cover (510) to extend from the cover (510) through the first aperture (511) or be retracted into the cover (510), a first spring (530) interposed between a rear surface of the protrusion section (520) and an inner surface of the cover (510) to apply elastic force to the protrusion section (520) to cause the protrusion section (520) to extend from the cover (510) through the first aperture (511), a lever fixing section (540) configured to fix the protrusion section (520) when the protrusion section (520) is retracted into the cover (510), a pin (550) for mounting the lever fixing section (540) to allow the lever fixing section (540) to be rotatable relative to the cover (510), and a second spring (560) configured to apply elastic force to the lever fixing section (540) in a direction in which the protrusion section (520) is fixed.

The lever fixing section (540) may include a plate-shaped body (541), a contact portion (542), bent from a first end of the body (541) and coming into contact with a front surface of the protrusion section (520) for fixing the protrusion section (520), and a push button portion (543) that extends from a second end of the body (541) and passing through the second aperture (512). The protrusion section (520) may have a stepped portion formed on a side thereof toward the second lever (300) to come into contact with (e.g., abut) the contact portion (542).

In accordance with another exemplary embodiment of the present invention, a method of actuating a hood latch assembly for a vehicle may include popping up (e.g., unlatching) a hood (1) by rotating a first latch (100) in a first opening direction (A) by operation of a first lever disposed within a driver's seat, and by pushing a striker (2) mounted on a lower surface of the hood (1) (S110), moving a first link (800), rotatably connected to a lower end of the first latch (100), in a second opening direction (A') by rotation of the first latch (100) (S120), moving a joint (700), connected to the first link (800), and a guide link (900), connected to the joint (700), along a guide aperture (410) in the second opening direction (A') (S130), rotating the joint (700) in the first opening direction (A) after the guide link (900) comes into contact with a first end of the guide aperture (410) (S140), rotating a second link (600) in the first opening direction (A) by rotation of the joint (700) (S150), generating collision between a push button portion (543) and the second lever (300) by rotation of an extendable lever (500) connected to the second link (600) (S160), rotating a lever fixing section (540) about a pin (550) by force that the push button portion (543) is pushed inward from a cover (510), to cause a protrusion section (520) to extend outward through a first aperture (511) (S170), rotating the extendable lever (500) and the second lever (300) in the first opening direction (A) by force applied to one surface of the protrusion section (520), to release the striker (2) from a second latch (200) (S180), and opening the hood (1) after the striker (2) is released (S190).

The method may further include restricting the protrusion section (520) by the lever fixing section (540) using elastic force of a second spring (560) (S210), closing the hood (1), and restricting the striker (2) to the second latch (200) by weight of the hood (1) (S220), inserting the protrusion section (520) into the extendable lever (500) by force applied to a front surface of the protrusion section (520) (S230), and restricting the striker (2) to the first latch (100) by force applied in a direction of gravity from an upper surface of the hood (1) (S240).

The restricting of the striker (2) to the first latch (100) (S240) may include rotating the first latch (100) in a first closing direction (B) (S241), moving the first link (800) in a second closing direction (B') (S242), moving the joint (700) along the guide aperture (410) in the second closing direction (B') while the joint (700) rotates in the first closing direction (B) (S243), and rotating the second link (600) connected to the joint (700) in the first closing direction (B) (S244).

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
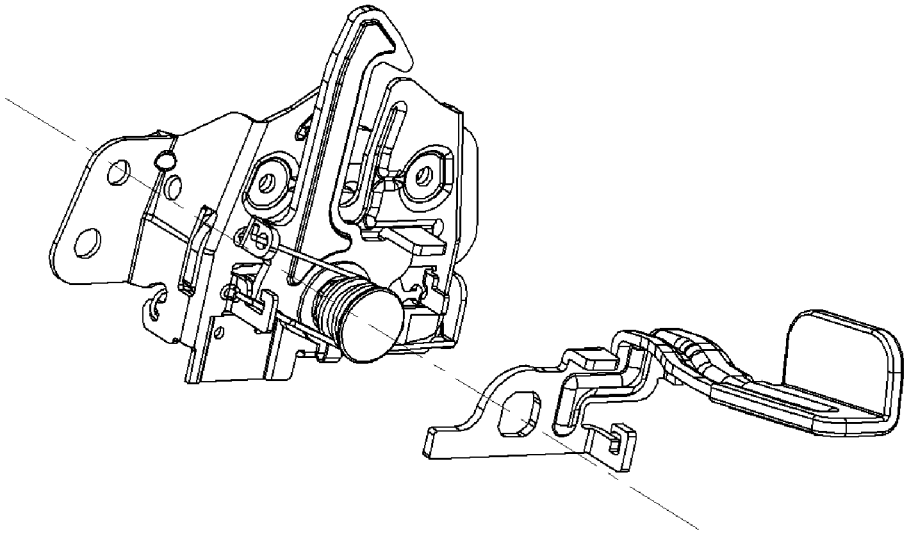
FIG.1 (Prior Art)
FIG. 1 is a detailed view illustrating a hood latch assembly for a vehicle according to the prior art.
Figure 2:
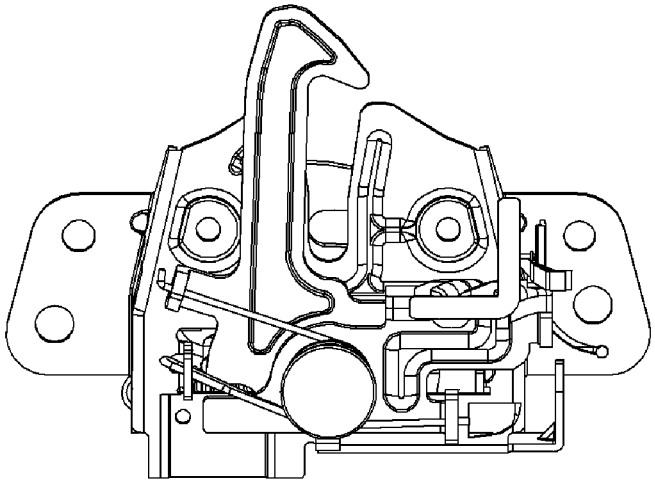
FIG.2 (Prior Art)
FIG. 2 is a front view illustrating the hood latch assembly for a vehicle according to the prior art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The terms and words used in the specification and claims should not be construed as their ordinary or dictionary sense. On the basis of the principle that the inventor can define the appropriate concept of a term in order to describe his/her own invention in the best way, it should be construed as meaning and concepts for complying with the technical idea of the present invention. Accordingly, the exemplary embodiments described in the present specification and the construction shown in the drawings are nothing but one exemplary embodiment of the present invention, and it does not cover all the technical ideas of the invention. Thus, it should be understood that various changes and modifications may be made at the time of filing the present application. In addition, detailed descriptions of functions and constructions well known in the art may be omitted to avoid unnecessarily obscuring the gist of the present invention. Exemplary embodiments of the present invention will be described below in more detail with reference to the accompanying drawings.

Figure 3:
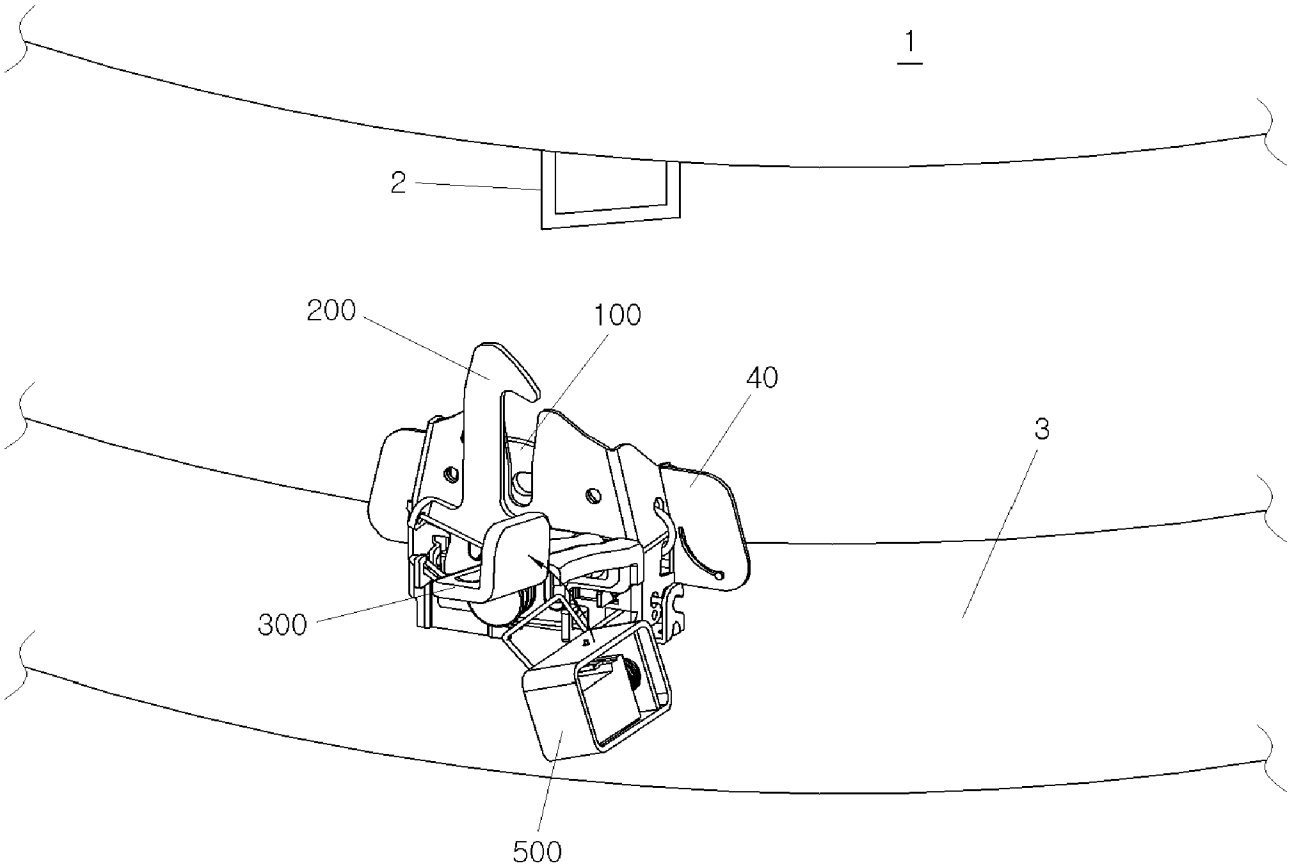
FIG. 3 is a front view illustrating a hood latch assembly for a vehicle according to an exemplary embodiment of the present invention.
Figure 4:
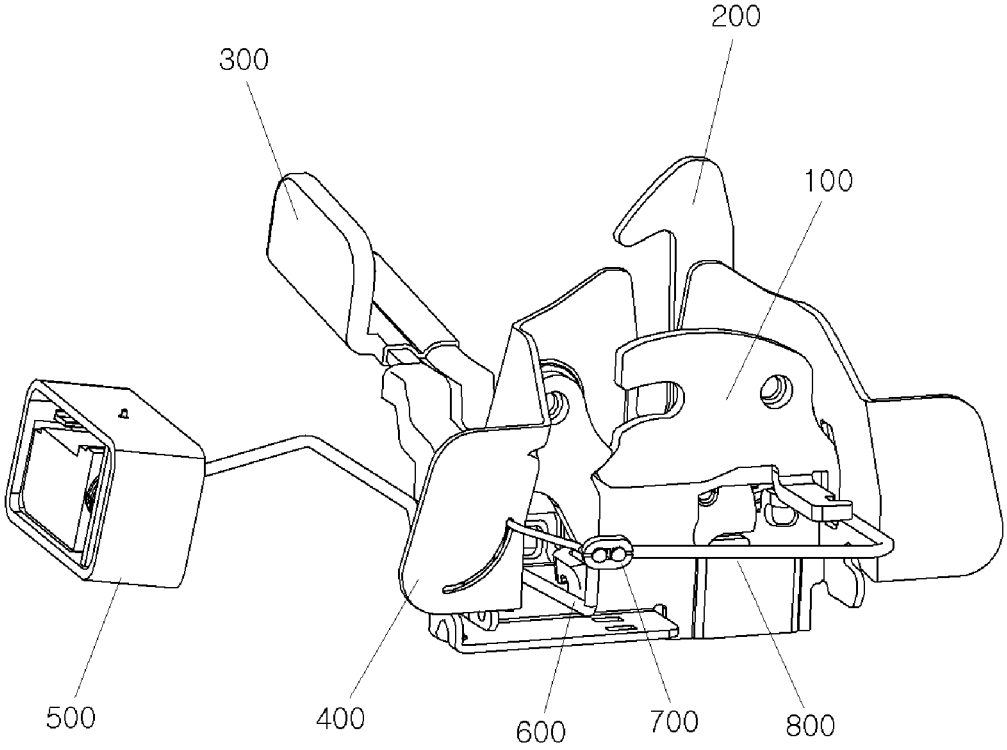
FIG. 4 is a rear view illustrating the hood latch assembly for a vehicle according to the exemplary embodiment of the present invention.
Figure 5:
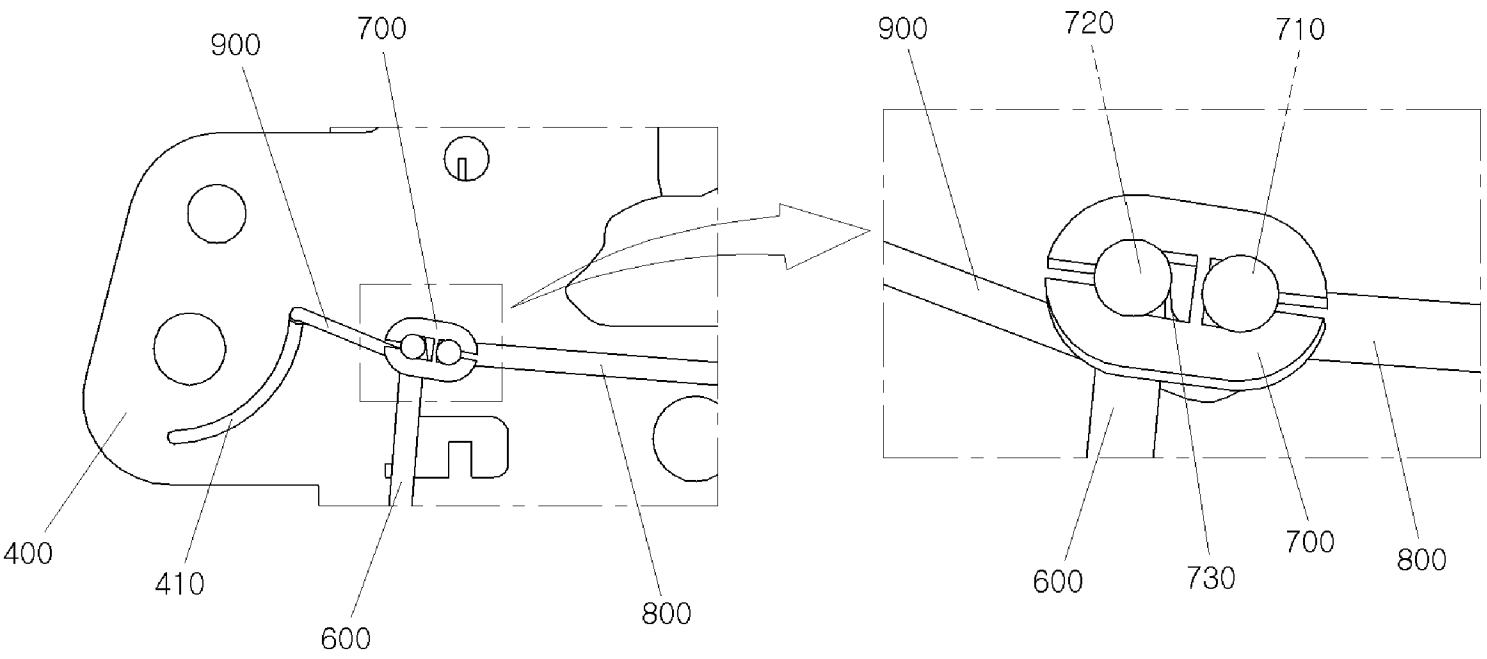
FIG. 5 is an enlarged rear view illustrating the hood latch assembly for a vehicle according to the exemplary embodiment of the present invention.
Figure 6:
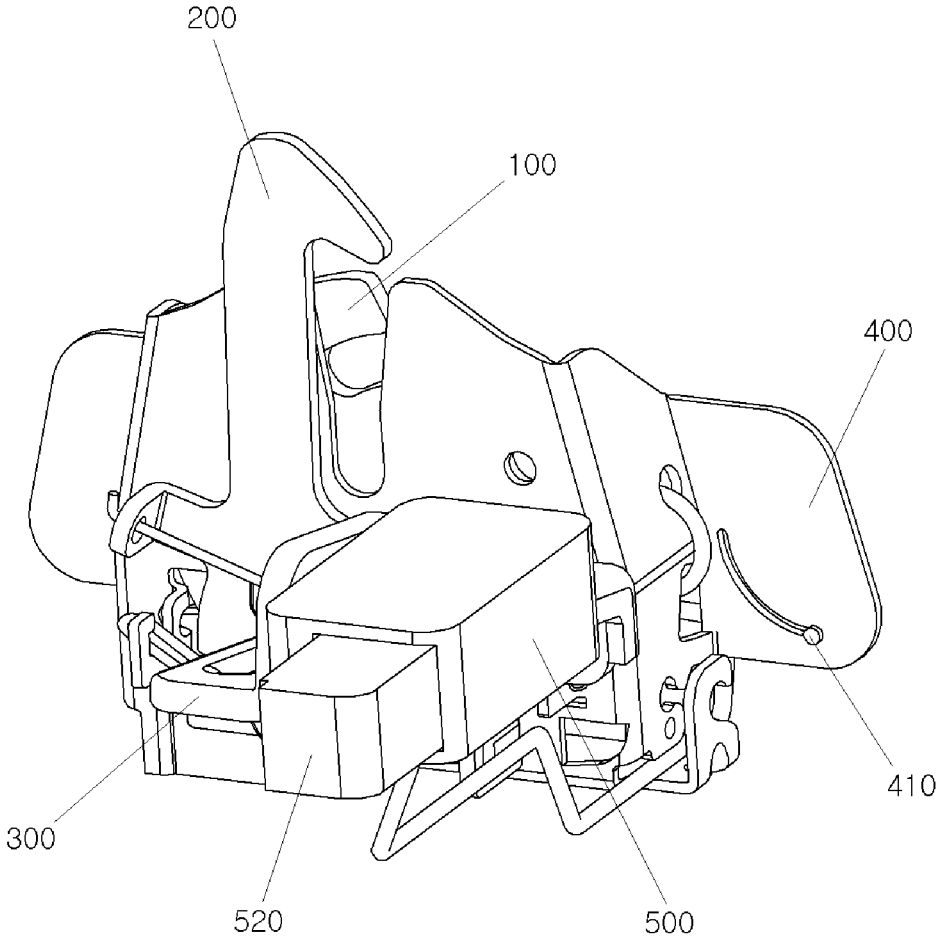
FIG. 6 is a front view illustrating the state in which the hood latch assembly for a vehicle is popped up according to the exemplary embodiment of the present invention.
Figure 7:
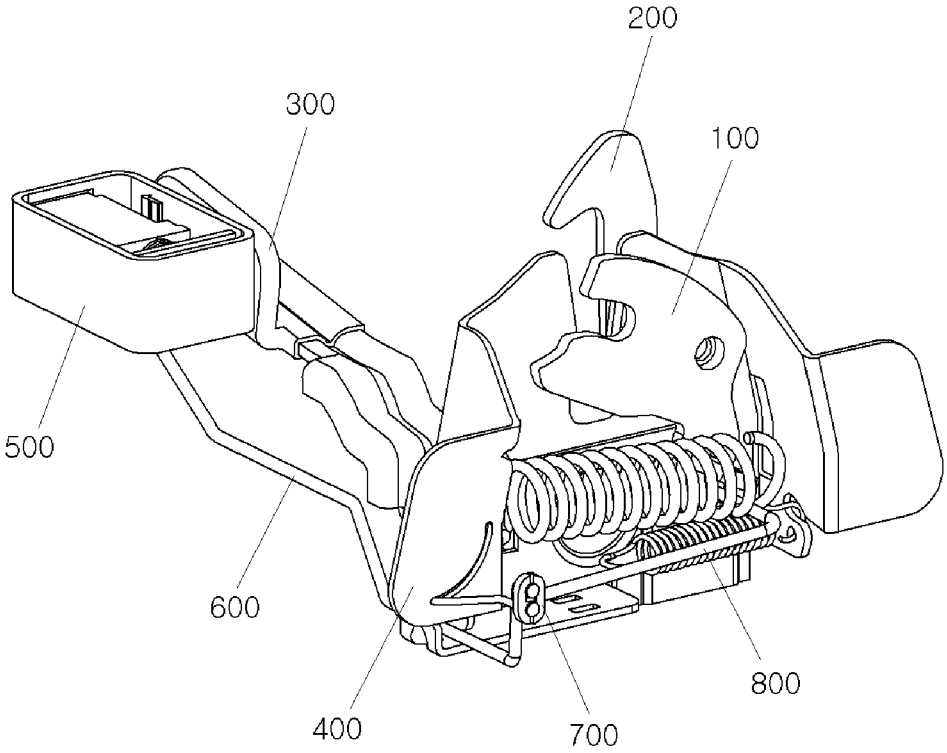
FIG. 7 is a rear view illustrating the state in which the hood latch assembly for a vehicle is popped up according to the exemplary embodiment of the present invention.
Figure 8:
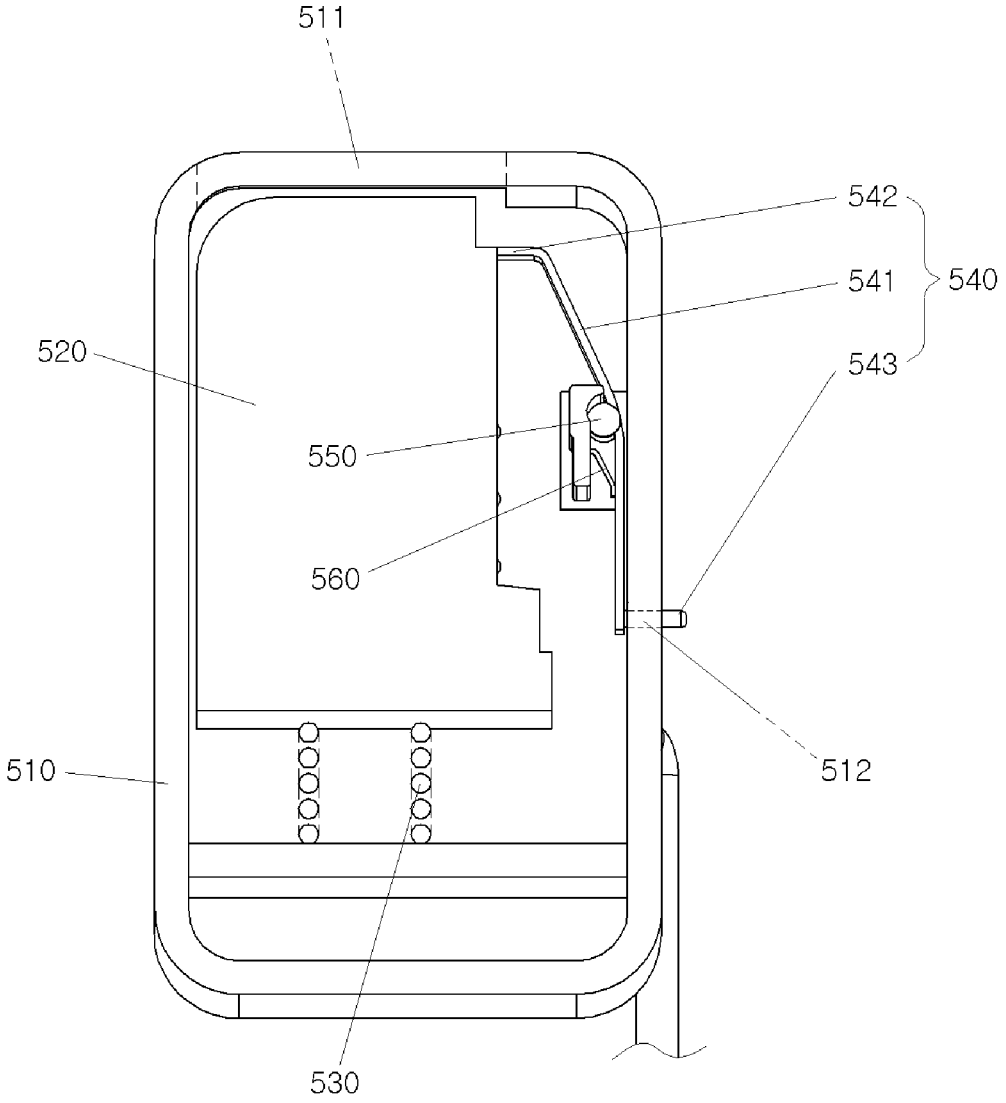
FIG. 8 is a planar cross-sectional view illustrating an extendable lever of the hood latch assembly for a vehicle according to the exemplary embodiment of the present invention.
Figure 9:
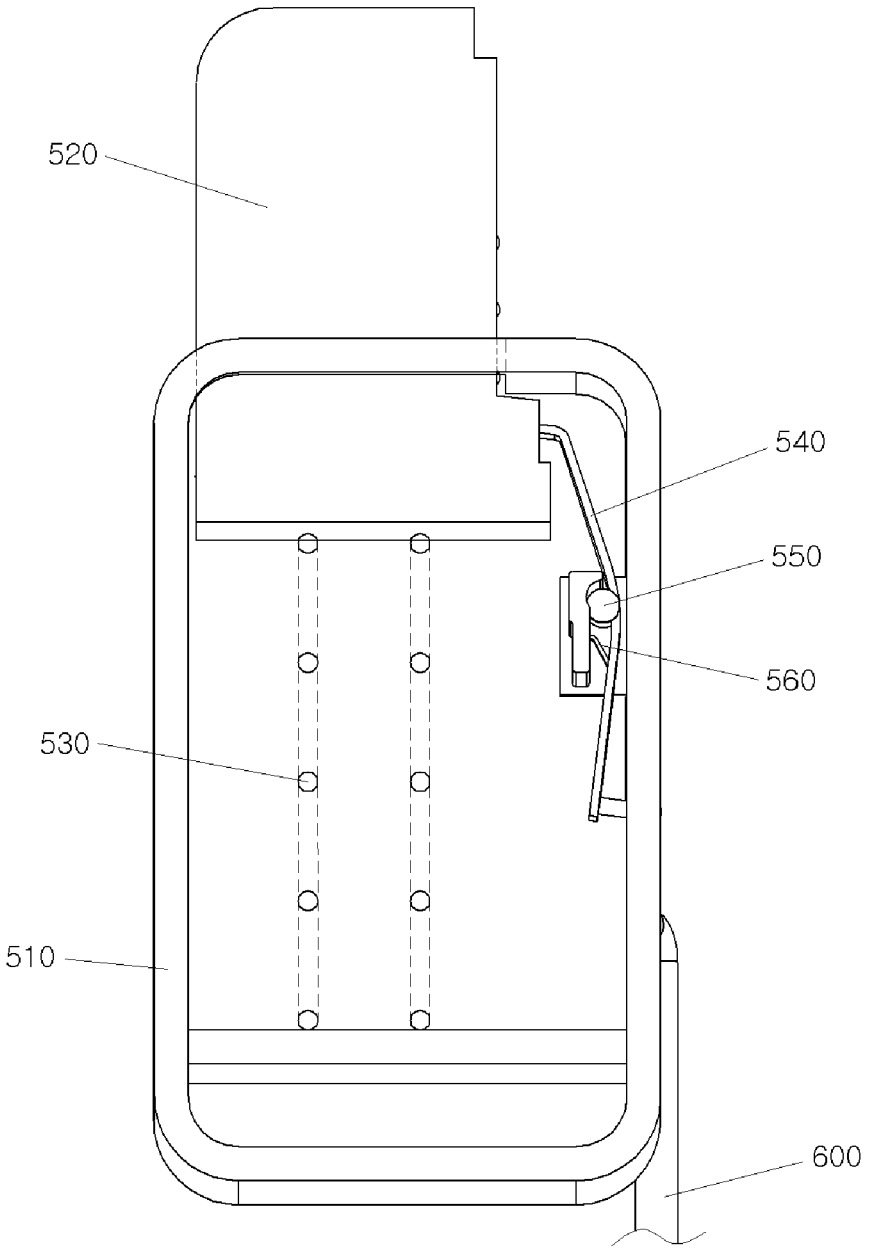
FIG. 9 is a planar cross-sectional view illustrating the state in which the extendable lever of the hood latch assembly for a vehicle is popped up according to the exemplary embodiment of the present invention.

FIG. 3 is a front view illustrating a hood latch assembly for a vehicle according to an exemplary embodiment of the present invention. FIG. 4 is a rear view illustrating the hood latch assembly for a vehicle according to the exemplary embodiment of the present invention. FIG. 5 is an enlarged rear view illustrating the hood latch assembly for a vehicle according to the exemplary embodiment of the present invention. FIG. 6 is a front view illustrating the state in which the hood latch assembly for a vehicle is popped up according to the exemplary embodiment of the present invention. FIG. 7 is a rear view illustrating the state in which the hood latch assembly for a vehicle is popped up according to the exemplary embodiment of the present invention. FIG. 8 is a planar cross-sectional view illustrating an extendable lever of the hood latch assembly for a vehicle according to the exemplary embodiment of the present invention. FIG. 9 is a planar cross-sectional view illustrating the state in which the extendable lever of the hood latch assembly for a vehicle is popped up according to the exemplary embodiment of the present invention. Referring to FIGS. 3 to 8, the hood latch assembly for a vehicle according to the exemplary embodiment of the present invention may include a first latch 100, a second latch 200, a second lever 300, a housing 400, and an extendable lever 500.

Particularly, the first latch 100 may be rotated in a first opening direction A by the operation of a first lever disposed within a driver's seat, and may be configured to push a striker 2 mounted on the lower surface of a hood 1 to pop up (e.g., unlatch, partially open, etc.) the hood 1. The second latch 200 may be configured to restrict or release the striker 2, and may couple or decouple the hood 1 to or from a vehicle body 3. The second lever 300 may be configured to rotate the second latch 200 to cause the second latch 200 to release the restriction of the striker 2. The first and second latches 100 and 200 and the second lever 300 may be installed within the housing 400.

In addition, the extendable lever 500 may be disposed at the side of the second lever 300, and may extend, when the hood 1 is popped up, to protrude toward the outside. In other words, the hood latch assembly may include the extendable lever 500 independently of the second lever 300, thereby resolving a difficulty of detecting the second lever 300 by a driver or an operator. Additionally, when the driver or operator pushes the extendable lever 500, the extendable lever 500 may be configured to push the second lever 300 to allow the second latch 200 to release the restriction of the striker 2.

Hereinafter, the connection between the extendable lever 500 and other components will be described in detail.

A first end of a second link 600 may be mounted to the lower surface of the extendable lever 500, and a first link 800 may be rotatably connected to the lower end of the first latch 100. In addition, the second link 600 may be connected to the first link 800 by a joint 700. A first end of a guide link 900 may be rotatably connected to the joint 700, and a second end thereof may be inserted into a guide aperture 410 formed in the housing 400, to guide the movement path of the joint 700. The joint 700 may include a first joint aperture 710 into which a first end of the first link 800 may be inserted, a second joint aperture 720 into which the second end of the second link 600 may be inserted, and a joint spring 730 which is disposed in the second joint aperture 720 to apply elastic force to the second link 600 to space the extendable lever 500 apart from the second lever 300 by a predetermined distance.

Hereinafter, the extendable lever 500 will be described in detail.

The extendable lever 500 may include a cover 510 which has a first aperture 511 formed in the front surface thereof and a second aperture 512 formed in the side thereof toward the lever, a protrusion section 520 disposed inside the cover 510 to extend from the cover 510 through the first aperture 511 or be retracted into the cover 510, a first spring 530 interposed between the rear surface of the protrusion section 520 and the inner surface of the cover 510 to apply elastic force to the protrusion section 520 to allow the protrusion section 520 to extend from the cover 510 through the first aperture 511, a lever fixing section 540 configured to fix the protrusion section 520 when the protrusion section 520 is retracted into the cover 510, a pin 550 for mounting the lever fixing section 540 to allow the lever fixing section 540 to be rotatable relative to the cover 510, and a second spring 560 configured to apply elastic force to the lever fixing section 540 in the direction in which the protrusion section 520 is fixed.

In addition, the lever fixing section 540 may include a plate-shaped body 541, a contact portion 542 bent from a first end of the body 541 and comes into contact with the front surface of the protrusion section 520 to fix the protrusion section 520, and a push button portion 543 which protrudes from a second end of the body 541 and passes through the second aperture 512. In addition, the protrusion section 520 may have a stepped portion (e.g., a portion formed with different levels) formed on the side thereof toward the second lever 300 to come into contact with the contact portion 542.

Figure 10:
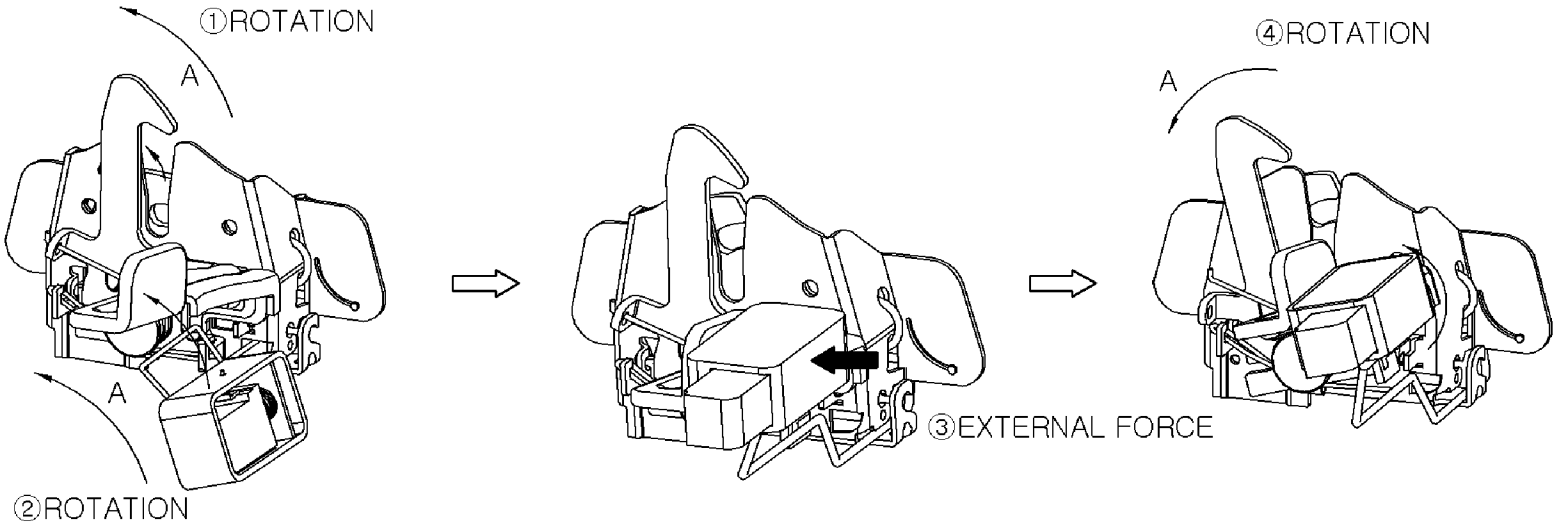
FIG. 10 is a view illustrating the state of actuation of the hood latch assembly for a vehicle when the hood thereof is opened according to the exemplary embodiment of the present invention.
Figure 11:
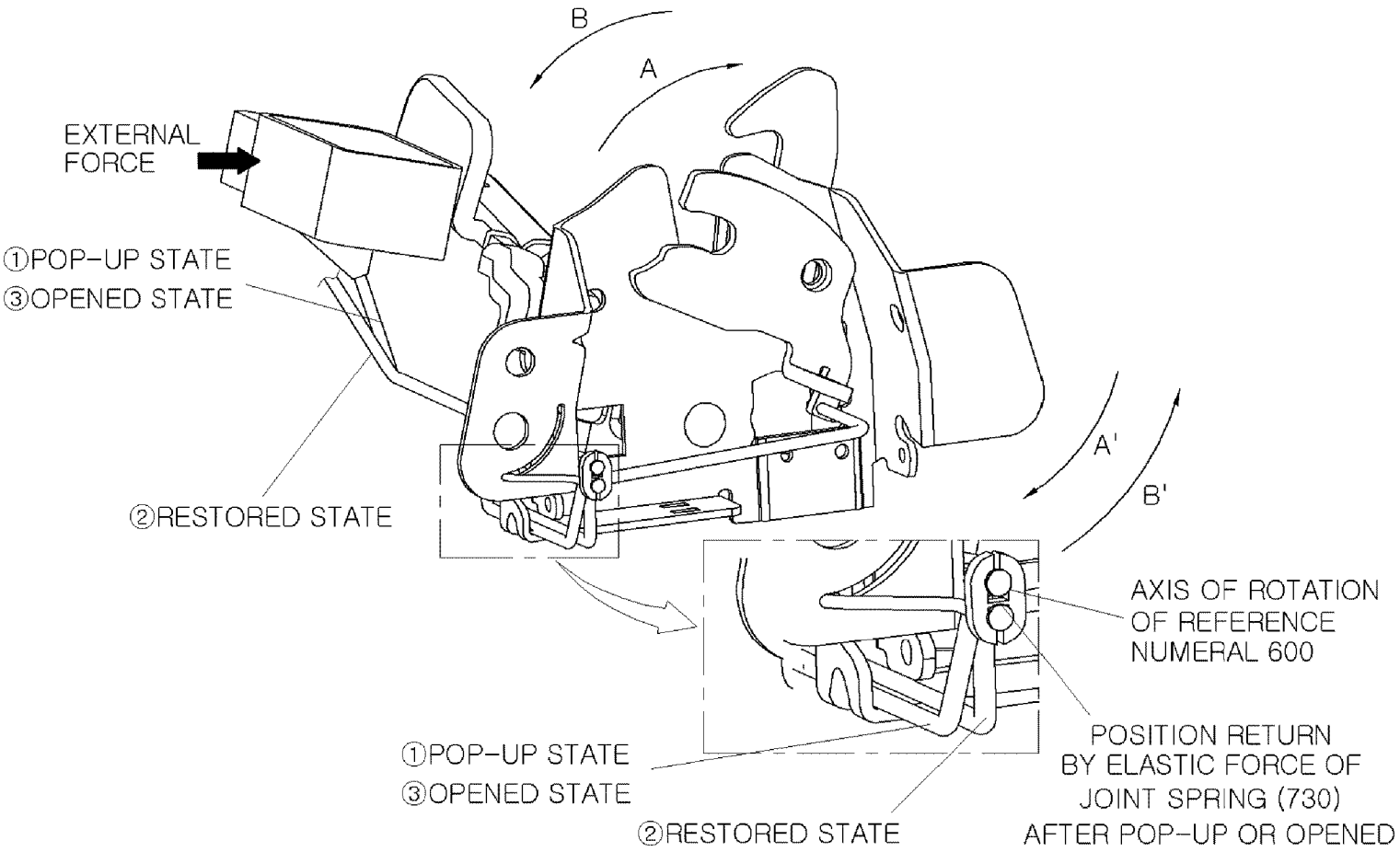
FIG. 11 is a view illustrating the actuation of the hood latch assembly for a vehicle according to the exemplary embodiment of the present invention.
Figure 12:
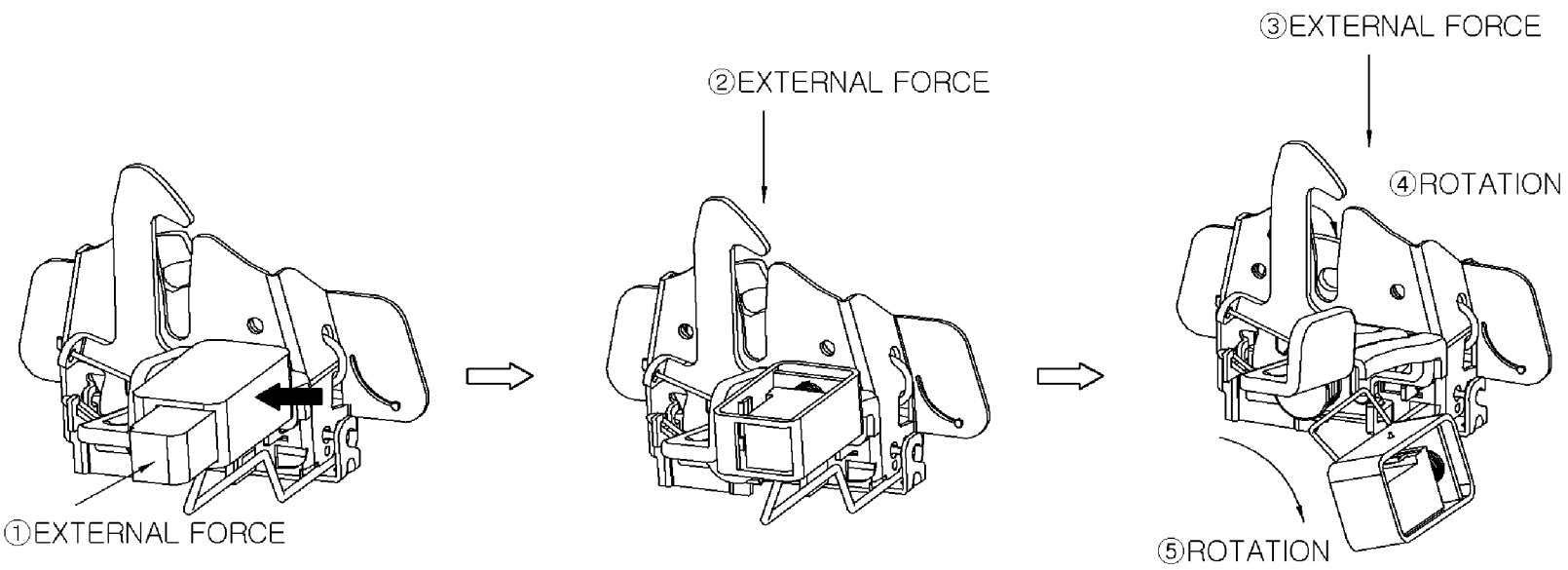
FIG. 12 is a view illustrating the state of actuation of the hood latch assembly for a vehicle when the hood thereof is closed according to the exemplary embodiment of the present invention.
Figure 13:
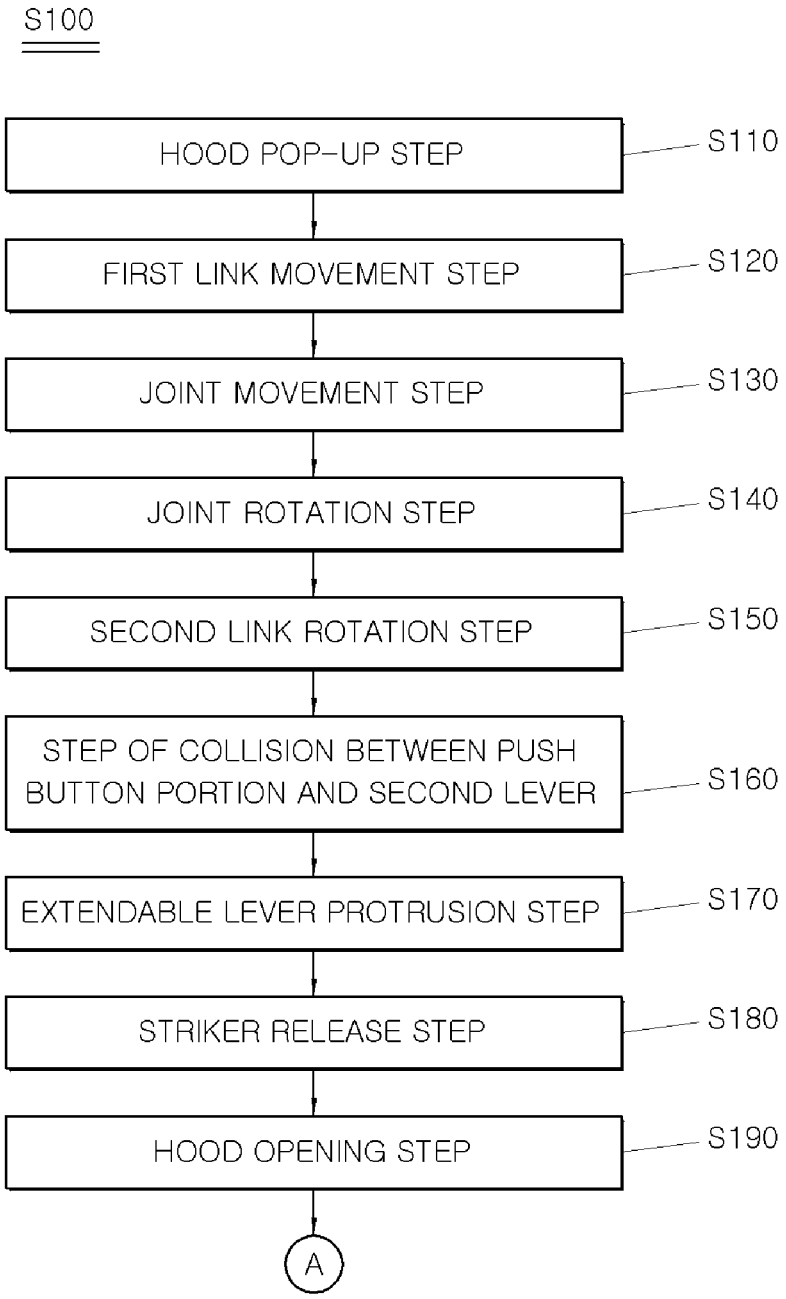
FIGS. 13 and 14 are flowcharts illustrating a method of actuating a hood latch assembly for a vehicle according to another exemplary embodiment of the present invention.
Figure 14:
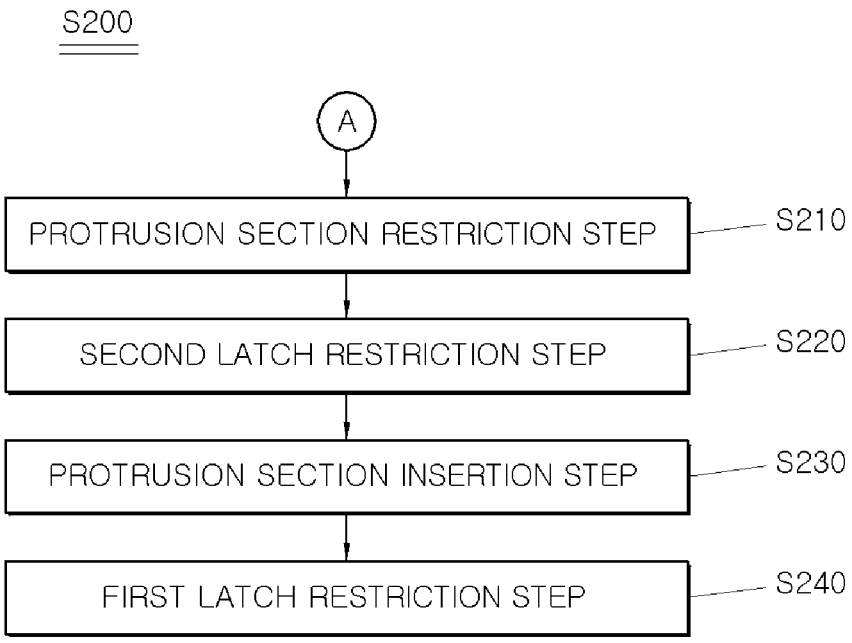

FIG. 10 is a view illustrating the state of actuation of the hood latch assembly for a vehicle when the hood thereof is opened according to the exemplary embodiment of the present invention. FIG. 11 is a view illustrating the actuation of the hood latch assembly for a vehicle according to the exemplary embodiment of the present invention. FIG. 12 is a view illustrating the state of actuation of the hood latch assembly for a vehicle when the hood thereof is closed according to the exemplary embodiment of the present invention. FIGS. 13 and 14 are flowcharts illustrating a method of actuating a hood latch assembly for a vehicle according to another exemplary embodiment of the present invention. Referring to FIGS. 10 to 14, the method of actuating the hood latch assembly for a vehicle according to another exemplary embodiment of the present invention may include a hood-opening step (S100) and a hood-closing step (S200).

Particularly, the hood-opening step (S100) may include a step in which a hood 1 is popped up (S110), moving a first link 800 (S120), moving a joint 700 (S130), rotating the joint 700 (S140), rotating a second link 600 (S150), a step in which a push button portion 543 collides with a second lever 300 (S160), a step in which a protrusion section 520 of an extendable lever 500 protrudes (S170), releasing a striker 2 (S180), and opening the hood 1 (S190). Hereinafter, the hood-opening step (S100) will be described in detail.

In step S110, a first latch 100 may be rotated in a first opening direction A by the operation of a first lever disposed within a driver's seat, and pushes (e.g., exerts pressure onto) a striker 2 mounted on the lower surface of the hood 1 to pop up (e.g., unlatch, disengage, etc.) the hood 1 (see the first drawing in FIG. 10). In step S120, the first link 800, which is rotatably connected to the lower end of the first latch 100, may be moved in a second opening direction A' by the rotation of the first latch 100 (see the first drawing in FIG. 10 and FIG. 11). In step S130, the joint 700, which is connected to the first link 800, and a guide link 900, which is connected to the joint 700, may move along a guide aperture 410 in the second opening direction A' (see the first drawing in FIG. 10 and FIG. 11).

In step S140, after the guide link 900 comes into contact with a first end of the guide aperture 410, the joint 700 may be configured to rotate in the first opening direction A (see the first drawing in FIG. 10 and FIG. 11). In step S150, the second link 600 may be configured to rotate in the first opening direction A by the rotation of the joint 700 (see the first drawing in FIG. 10 and the pop-up state in FIG. 11). In step S160, the push button portion 543 may collide with the second lever 300 by the rotation of the extendable lever 500 connected to the second link 600 (see the second drawing in FIG. 10).

Further, in step S170, a lever fixing section 540 may be configured to rotate about a pin 550 by the force that the push button portion 543 is pushed inward from the cover 510, and the protrusion section 520 extends outward through a first aperture 511 (see the second drawing in FIG. 10). A joint spring 730 may then be configured to apply elastic force to the second link 600. Thus, the second link 600 may be configured to rotate by a predetermined angle in a direction opposite to the first opening direction A, and the second lever 300 may be spaced apart from the extendable lever 500 by a predetermined distance (see the restored state in FIG. 11).

In step S180, the extendable lever 500 and the second lever 300 may be rotated in the first opening direction A by force applied to one surface of the protrusion section 520, to release the striker 2 from the second latch 200 (see the second and third drawings in FIG. 10 and the opened state in FIG. 11). In other words, the second lever 300 and the extendable lever 500, which are spaced apart from each other by the predetermined distance, come into contact with each other again, and then rotate in the first opening direction A.

Additionally, in step S190, after the striker 2 is released, the hood 1 may be opened by the external force from a driver or an operator (see the third drawing in FIG. 10). In addition, after the hood 1 is opened, all of the second latch 200, the extendable lever 500, and the second lever 300 may be returned to original positions (the positions in step S170) by the elastic force of a return spring (not shown).

Moreover, the hood-closing step (S200) may include inserting the protrusion section (S210), restricting the protrusion section 520 (S220), restricting the striker 2 to the second latch 200 (S230), and restricting the striker 2 to the first latch 100 (S240). Hereinafter, the hood-closing step (S200) will be described in detail. In step S210, the protrusion section 520 may be inserted into the extendable lever 500 by force applied to the front surface of the protrusion section 520 (see the first drawing in FIG. 12). In step S220, the lever fixing section 540 may be configured to restrict the protrusion section 520 using the elastic force of the second spring 560 (see the first drawing in FIG. 12).

Further, in step S230, the hood 1 may be closed, and the striker 2 may be restricted to the second latch 200 by the weight of the hood 1 (see the second drawing in FIG. 12). In other words, the hood 1 may be returned to be popped up. In step S240, the striker 2 may be restricted to the first latch 100 by force applied in the direction of gravity from the upper surface of the hood 1 (see the third drawing in FIG. 12). In other words, the hood 1 may be restricted to the vehicle body 3 (e.g., the hood 1 may be held in place against the vehicle body 3 to lock the hood 1 in place). The step in which the striker 2 is restricted to the second latch 200 (S230) and the step in which the striker 2 is restricted to the first latch 100 (S240) may be sequentially performed, or may be performed simultaneously.

Hereinafter, the step in which the striker 2 is restricted to the first latch 100 (S240) will be described in detail. The step (S240) may include a step in which the first latch 100 rotates in a first closing direction B (S241) (see the third drawing in FIG. 12 and FIG. 11), a step in which the first link 800 moves in a second closing direction B' (S242) (see the third drawing in FIG. 12 and FIG. 11), a step in which the joint 700 moves along the guide aperture 410 in the second closing direction B' while rotating in the first closing direction B (S243) (see the third drawing in FIG. 12 and FIG. 11), and a step in which the second link 600 connected to the joint 700 rotates in the first closing direction B (S244) (see the third drawing in FIG. 12 and FIG. 11).

In accordance with the exemplary embodiments of the present invention, the driver or operator may open the hood of a vehicle more easily. In addition, since the hands of the driver or operator are not stained when the hood is opened, it is possible to improve customer satisfaction.

While the present invention has been described with respect to the exemplary embodiments, it will be apparent to those skilled in the art that various changes and modifications may be made without departing from the spirit and scope of the invention as defined in the following claims.

What is claimed is:

1. A hood latch assembly for a vehicle, comprising:

a first latch rotated in a first opening direction by operation of a first lever disposed within a driver's seat, to push a striker mounted on a lower surface of a hood to pop up the hood;

a second latch configured to restrict or release the striker, to maintain the hood in a pop-up position or decouple the hood to or from a vehicle body;

a second lever configured to rotate the second latch to cause the second latch to release restriction of the striker;

a housing that accommodates the first and second latches and the second lever;

an extendable lever configured to be moved from a first position inside the vehicle to a second position outward disposed at a side of the second lever when the hood is popped up and configured to move the second lever to rotate when the extendable lever is manually operated;

a second link, a first end of which is mounted to a lower surface of the extendable lever; and a first link, a first end of which is connected to a second end of the second link by a joint and a second end thereof is rotatably connected to a lower end of the first latch.

2. The hood latch assembly of claim 1, further comprising:

a guide link, a first end of which is rotatably connected to the joint and a second end thereof is inserted into a guide aperture formed in the housing to guide a movement path of the joint.

3. The hood latch assembly of claim 2, wherein the joint includes a first joint aperture into which a first end of the first link is inserted.

4. The hood latch assembly of claim 3, wherein the joint includes:

a second joint aperture into which a second end of the second link is inserted.

5. The hood latch assembly of claim 4, wherein the joint includes:

a joint spring disposed in the second joint aperture to apply elastic force to the second link to space the extendable lever apart from the second lever by a predetermined distance.

6. The hood latch assembly of claim 1, wherein the extendable lever includes:

a cover including a first aperture formed in a front surface thereof and a second aperture formed in a side thereof toward the second lever; and a protrusion section disposed inside the cover to protrude from the cover through the first aperture or be retracted into the cover.

7. The hood latch assembly of claim 6, wherein the extendable lever includes:

a first spring interposed between a rear surface of the protrusion section and an inner surface of the cover to apply elastic force to the protrusion section to allow the protrusion section to extend from the cover through the first aperture.

8. The hood latch assembly of claim 7, wherein the extendable lever includes:

a lever fixing section configured to fix fixing the protrusion section when the protrusion section is retracted into the cover.

9. The hood latch assembly of claim 8, wherein the extendable lever includes:

a pin for mounting the lever fixing section to allow the lever fixing section to be rotatable relative to the cover.

10. The hood latch assembly of claim 9, wherein the extendable lever includes:

a second spring configured to apply elastic force to the lever fixing section in a direction in which the protrusion section is fixed.

11. The hood latch assembly of claim 8, wherein the lever fixing section includes a plate-shaped body.

12. The hood latch assembly of claim 11, wherein the lever fixing section includes:

a contact portion, bent from a first end of the body and coming into contact with a front surface of the protrusion section to fix the protrusion section.

13. The hood latch assembly of claim 12, wherein the lever fixing section includes:

a push button portion that protrudes from a second end of the body and passes through the second aperture.

14. The hood latch assembly of claim 13, wherein the protrusion section has a stepped portion formed on a side thereof toward the second lever to come into contact with the contact portion.

15. A method of actuating a hood latch assembly for a vehicle, comprising:

popping up a hood by rotating a first latch in a first opening direction by operation of a first lever disposed within a driver's seat, and by pushing a striker mounted on a lower surface of the hood;

moving a first link, rotatably connected to a lower end of the first latch, in a second opening direction by rotation of the first latch;

moving a joint, connected to the first link, and a guide link, connected to the joint, along a guide aperture in the second opening direction;

rotating the joint in the first opening direction after the guide link comes into contact with a first end of the guide aperture;

rotating a second link in the first opening direction by rotation of the joint;

generating collision between a push button portion of an extendable lever and the second lever by rotation of the extendable lever connected to the second link;

rotating a lever fixing section of the extendable lever about a pin by force that the push button portion is pushed inward from a cover of the extendable lever, to cause a protrusion section to extend outward through a first aperture;

rotating the extendable lever and the second lever in the first opening direction by force applied to one surface of the protrusion section, to release the striker from a second latch; and opening the hood after the striker is released.

16. The method of claim 15, further comprising:

restricting the protrusion section by the lever fixing section using elastic force of a second spring;

closing the hood, and restricting the striker to the second latch by weight of the hood;

inserting the protrusion section into the extendable lever by force applied to a front surface of the protrusion section; and restricting the striker to the first latch by force applied in a direction of gravity from an upper surface of the hood.

17. The method of claim 16, wherein the restricting of the striker to the first latch includes:

rotating the first latch in a first closing direction;

moving the first link in a second closing direction;

moving the joint along the guide aperture in the second closing direction while the joint rotates in the first closing direction; and rotating the second link connected to the joint in the first closing direction.

* * * * *